United States Patent [19]

Bridegum

[11] Patent Number: 4,771,762

[45] Date of Patent: Sep. 20, 1988

[54] WATER HEATER FOR RECREATIONAL VEHICLE

[76] Inventor: James E. Bridegum, 10 De Anza Dr., Reno, Nev. 89511

[21] Appl. No.: 59,510

[22] Filed: Jun. 8, 1987

[51] Int. Cl.[4] ..... F24H 1/20

[52] U.S. Cl. ..... 126/360 R; 126/391; 122/17; 122/75

[58] Field of Search ..... 126/391, 360 R, 91 A; 122/17, 75, 136 R

[56] References Cited

U.S. PATENT DOCUMENTS

| | | | |
|---|---|---|---|
| 2,796,860 | 6/1957 | Pinkus et al. | 126/116 R |
| 3,056,400 | 10/1962 | Hammersley et al. . | |
| 3,062,233 | 11/1962 | Hammersley . | |
| 3,405,690 | 10/1968 | Burrus et al. | 122/136 R |

FOREIGN PATENT DOCUMENTS

| | | | |
|---|---|---|---|
| 422578 | 1/1935 | United Kingdom | 122/17 |

*Primary Examiner*—Carroll B. Dority, Jr.

*Attorney, Agent, or Firm*—Kelly, Bauersefeld & Lowry

[57] ABSTRACT

An improved compact water heater is provided for use in recreational vehicles and the like, wherein the water heater is designed for facilitated assembly and for increased heat transfer capacity to achieve reduced heater recovery time. The water heater comprises a compact tank with appropriate cold water supply and hot water outlet fittings. A combustor unit is mounted within the tank, wherein the combustor unit is defined by interconnected matched shell-shaped combustor sections cooperating to provide a generally U-shaped combustor flow path with extended heat transfer surface area for improved water heater performance with reduced recovery time.

13 Claims, 2 Drawing Sheets

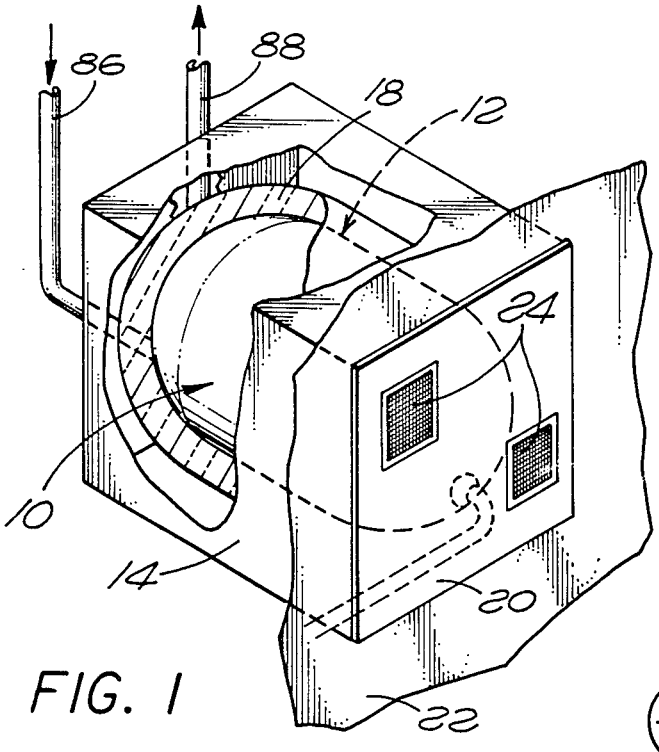
FIG. 1
FIG. 2
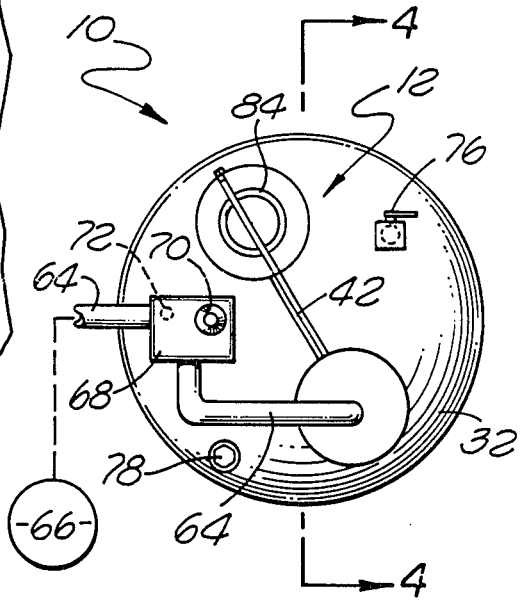
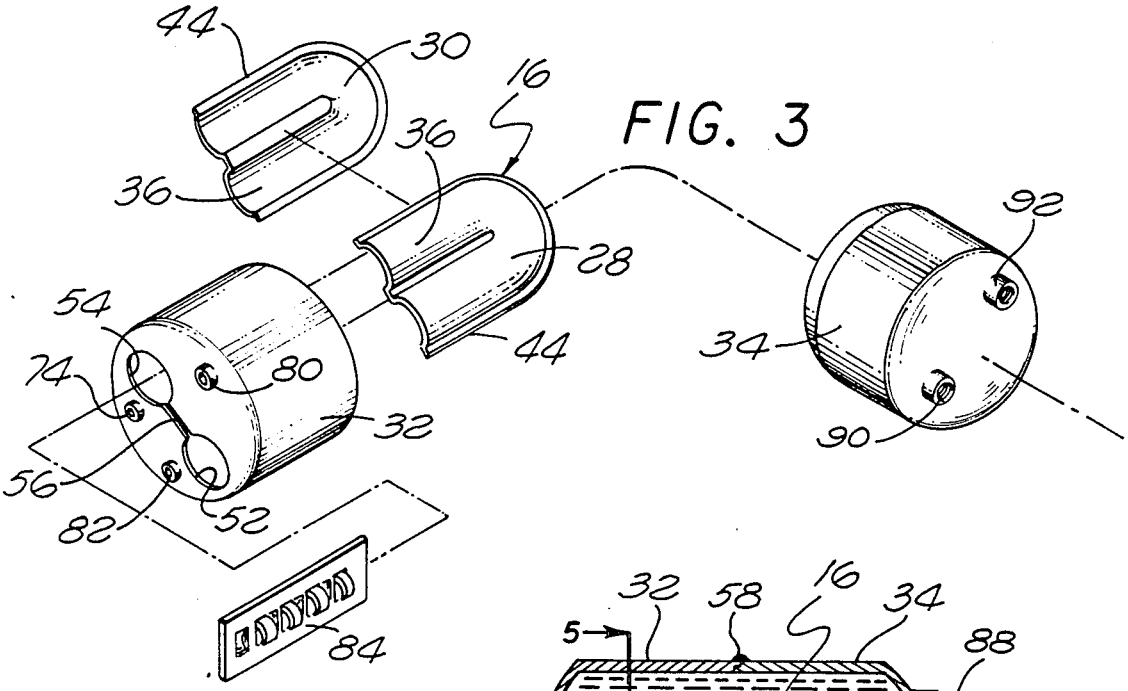
FIG. 3
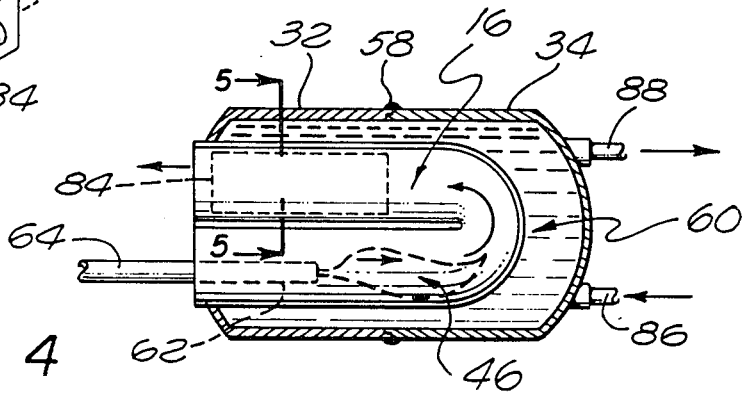
FIG. 4

WATER HEATER FOR RECREATIONAL VEHICLE

BACKGROUND OF THE INVENTION

This invention relates generally to improvements in compact hot water heaters, particularly of the gas-fired type used in recreational vehicles and the like to provide a portable supply of hot water. More particularly, this invention relates to an improved compact water heater for recreational vehicles and the like, wherein the water heater is designed for rapid, cost-efficient assembly with improved heat transfer for faster heater recovery times.

Compact water heaters of the type for use with recreational vehicles and the like are generally well known in the art and typically comprise a relatively small water tank in combination with an internal heating element conventionally of the gas-fired type. The water heater is mounted on the recreational vehicle in a convenient position connected to cold water supply and hot water outlet pipes respectively receiving cold water from a suitable water supply source and for directing heated water, normally at about 120° F. to 170° F., for use in cooking, bathing, and the like. In a standard commercially available water heater for recreational vehicles, the tank has a cylindrical shape about sixteen inches in length and about twelve inches in diameter, and has a capacity of about six gallons of water to be heated. The heater is normally mounted on the vehicle for convenient access through a hinged door or the like to selected control components including, for example, a thermostatic gas flow control valve, a pressure relief valve, drain plug, etc.

In the past, the desired compact size of the water tank used in recreational vehicle water heaters has placed significant design constraints upon the heating element extending into the tank for heating the water. More particularly, bent tube combustor elements have been used wherein a length of metal tubing bent to a generally U-shaped configuration is installed within the tank to define a generally U-shaped flow path extending in one direction into and then exiting in an opposite direction from the tank. Such bent tube structures have been limited to tubes of round cross sectional shape to provide a heating element capable of withstanding a typical tank pressure test at about 300 psi. A burner element is mounted near one open end of this bent tube flow path to create hot combustion products which travel through and are exhausted from the flow path, with a resultant heat transfer exchange with water in the tank. However, the compact tank profile significantly restricts the diametric size of the bent tubing which can be installed into the tank. This results in corresponding limmitations in tank heat transfer capacity, with a typical commercially available water heater of this type having a maximum heat transfer capacity of about 12,200 BTU's per hour.

Alternative combustor element configurations have included comparatively larger diameter straight tubes having one closed end and an internal median divider to define hemispherical flow paths extending into an exhausting from the tank. However, once again, this type of combustor element provides relatively limited heat transfer surface area with surrounding water in the tank to correspondingly limit the heat transfer capacity of the tank. Enhanced heat transfer capacity, of course, is extremely desirable since it would permit supply of increased quantities of hot water per hour, without increasing the size of the water heater.

There exists, therefore, a significant need for improvements in compact water heaters of the type designed, for example, for recreational vehicles and the like. In particular, there exists a need for an improved water heater having increased heat transfer capacity without increasing overall heater size, wherein an internal heating element for the water heater is easily assembled, provides substantial heat transfer surface area, and is capable of withstanding design pressure tests up to 300 psi. The present invention fulfills these needs and provides further related advantages.

SUMMARY OF THE INVENTION

In accordance with the invention, an improved compact water heater is provided particularly for use in recreational vehicles and the like. The improved water heater has a lightweight and low profile design with an improved combustor unit to achieve substantially increased heat transfer surface area, while providing the capability to withstand pressure testing of 300 psi or more. In addition, the water heater is designed for economical assembly on a production basis. Accordingly, the improved water heater provides a cost efficient unit for providing hot water with reduced recovery times.

In the preferred form, the improved hot water heater comprises a compact, generally cylindrical tank defined by interfitting, generally cup-shaped tank head and tail portions. The improved combustor unit is adapted for rapid assembly and installation into the tank head portion, after which the tank head and tail portions are joined together with the combustor unit providing significantly increased heat transfer surface area with water to be contained within the tank.

More specifically, the combustor unit is formed from a pair of matched, preferably identical, shell-shaped combustor sections interconnected as by welding along their exposed peripheries to define an elongated and generally U-shaped flow path. The assembled combustor unit is mounted within the tank head portion with open ends of the flow path exposed through a head portion end wall. Accordingly, one open end of the flow path provides an accessible combustor inlet for combustion air intake and installation of a suitable burner element, whereas the other end of the flow path defines a combustor outlet for exit passage of exhaust gases. The combustor inlet and outlet may be the same or different diametric sizes. The tank tail portion is then assembled with the tank head portion, by appropriate welding or the like, to enclose the combustor unit within the tank and to define a water chamber in intimate heat transfer surrounding relation with the combustor unit. Importantly, the flow path through the combustor unit is designed to withstand pressure testing typically at 300 psi, and the bend region of the U-shaped path may be and typically is formed on a radius smaller than the smallest radius to which tubing of similar size can be bent without risk of structural failure when subjected to operating pressures.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a fragmented perspective view illustrating an improved compact water heater embodying the novel features of the invention;

FIG. 2 is an enlarged front end elevation view of the water heater of FIG. 1;

FIG. 3 is an exploded perspective view illustrating tank and combustor unit components of the improved water heater of the present invention;

FIG. 4 is a longitudinal sectional view taken generally on the line 4—4 of FIG. 2;

DETAILED DESCRIPTION OF THE PREFERRED EMBODIMENT

Figure 6:
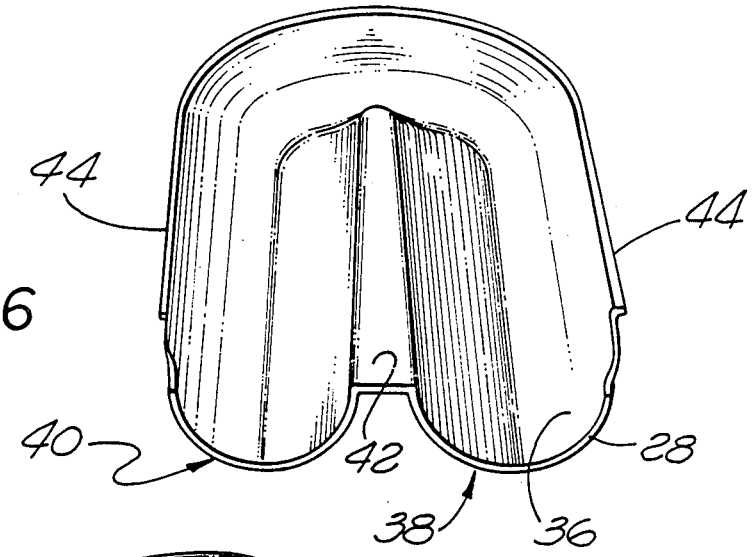
FIG. 6 is a perspective view illustrating one shell-shaped combustor section for use in forming the combustor unit of the improved water heater.

As shown in the exemplary drawings, an improved water heater is referred to generally in FIG. 1 by the reference numeral 10, wherein the heater 10 is designed particularly for use in a recreational vehicle or the like. The water heater 10 comprises a compact, relatively low profile tank 12 for installation into a relatively small housing 14 within the recreational vehicle. The heater 10 includes an improved internal combustor unit 16 (not shown in FIG. 1) designed for increased thermal exchange with water to be heated, thereby providing improved water heater performance and reduced recovery times.

The improved water heater 10 of the present invention is constructed from a relatively small number of easily manufactured and easily assembled components to provide a compact and lightweight water heater of efficient performance. The heater is designed for installation into a compact envelope or profile commonly used with water heaters in the recreational vehicle industry, yet the improved water heater 10 provides significantly increased heat transfer with water contained within the tank 12. Moreover, the heater 10 possesses significant structural integrity to withstand normal pressure testing, typically at about 300 psi. As a result, the present invention provides increased quantities of hot water per hour of operation with reduced recovery time between successive uses to deliver hot water. Accordingly, the water heater 10 provides significantly improved operation in comparison with prior art recreational vehicle water heaters of similar size, or, in the alternative, the present invention is competitive with larger, heavier, and more costly water heaters in recreational vehicles.

As shown generally in FIG. 1, the tank 12 for the improved water heater 10 has a generally cylindrical configuration on the order of twelve inches in diameter and about sixteen inches in length for conformance with industry standard water heater size specifications. The tank 12 is mounted on its side within the relatively small housing 14, with appropriate insulation material 18 being interposed between the tank exterior and housing walls, as is known in the art. The housing typically includes a hinged exterior access door 20 interrupting an outer panel 22 of the recreational vehicle, wherein the door can be opened when required for direct access to the water heater and associated control components. As shown in FIG. 1, the access door 20 conventionally includes one or more air open air vents 24 to permit intake of combustion air to the heater and exhaust discharge of combustion products, as will be described in more detail. These vents need not be identical in size.

The water heater 10 is shown in more detail in FIGS. 2–7 to include a relatively small number of components which can be assembled quickly and easily. More particularly, the water heater comprises the combustor unit 16 formed from a mating or matched pair of generally shell-shaped sections 28 and 30. The combustor unit 16 is in turn installed within the tank 12 which is formed from a mating or matched pair of generally cup-shaped head and tail portions 32 and 34. Various materials can be used in the construction of the combustor unit 16 and the tank 12, although one preferred material comprises aluminum in view of its relatively lightweight characteristics. Alternately, these components can be constructed from steel with the tank having a glass lining, if desired.

Figure 7:
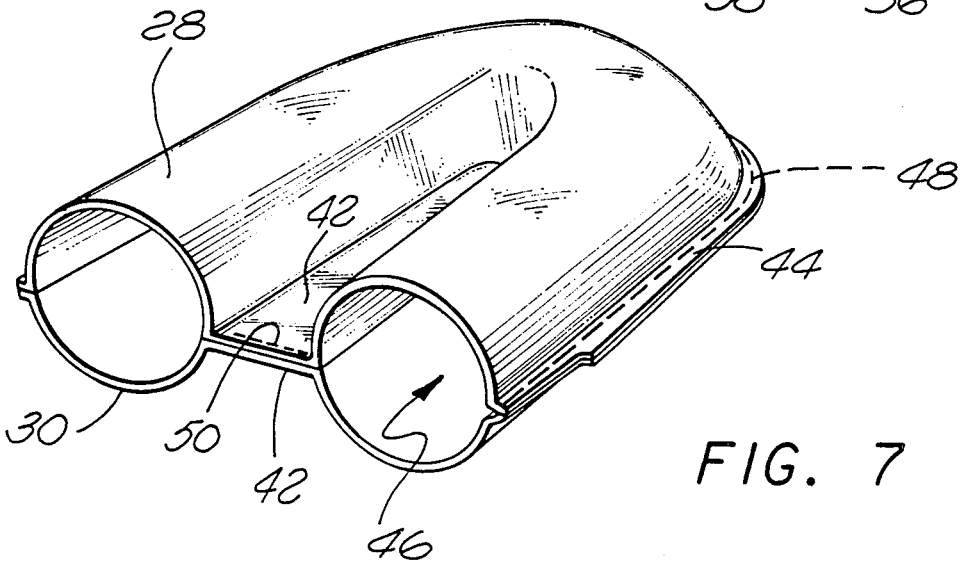
FIG. 7 is a perspective view illustrating the combustor unit in assembled form.
Figure 5:
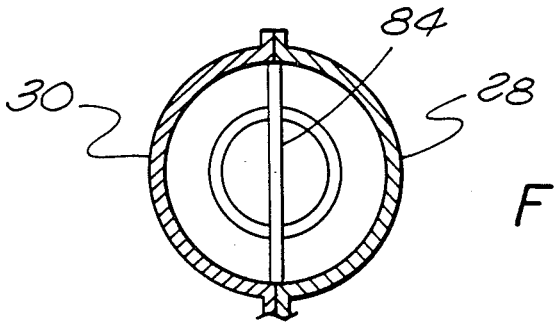
FIG. 5 is an enlarged sectional view taken generally on the line 5—5 of FIG. 4.

As shown best in FIGS. 6 and 7, the shell-shaped sections 28 and 30 forming the combustor unit 16 are, in the preferred form, identical to each other and can be constructed in a convenient manner in production quantities by appropriate stamping or the like from metal sheet stock. Each combustor section 28 and 30 comprises a longitudinally split or semitubular channel 36 of generally U-shaped configuration to extend from one open end depicted by arrow 38 along a first straight leg and then to curve through a smoothly contoured 180 degree bend to a second straight leg terminating in a second open end depicted by arrow 40. The interior region between the two straight legs is defined by an integral channel web 42. The outer periphery of the channel includes, in the illustrative embodiment, a short outwardly projecting lip 44. Alternately, the combustor sections can be constructed in other configurations for mating fit defining the combustor unit.

The combustor unit 16 is formed by assembling the two sections 28 and 30 in facing relation with their respective channels 36 cooperating with each other to form a single U-shaped path 46 (FIG. 7) of generally circular cross section and a substantial diametric size relative to tank water capacity. The two combustor sections 28 and 30 are fastened together quickly and easily by an elongated weld seam 48 joining the outer peripheral lips 44 together in a leak-free manner, wherein such welding process is conducive to automated manufacturing techniques and enables the unit to withstand standard water heater pressure tests of typically about 300 psi. Alternately, if desired, the outer peripheries of these combustor sections 28 and 30 can assume different configurations for connection, for example, by butt welding, lap welding, etc., as desired. Still further, if desired, the facing webs 42 of the two combustor sections 28 and 30 may also be joined together by brazing or welding, or, if desired, the stretch of the webs 42 extending between the open ends of the channels 36 can be joined by a weld seam 50 (FIG. 7). However, these webs 42 need not be welded, since they are generally self-sealing when the combustor unit 16 is welding into the tank head portion 32, as will be described.

After formation, the combustor unit 16 is tested to insure leak-free integrity of the flow path 46. After testing, the tubular open ends of the combustor unit are fitted quickly and easily through a matingly shaped pair of openings 52 and 54 in the end wall of the tank head portion 32. A portion of the central web 42 also conveniently fits through a narrow slot 56 between the two openings 52 and 54. These portions of the combustor unit 16 protruding through the tank head portion 32 are then secured in place by welding or the like to seal the combustor unit flow path from the interior of the tank.

With the combustor unit 16 secured within the tank head portion 32, the tank head and tail portions are joined together with appropriate connection means, such as a weld 58. In this configuration, as shown best in FIG. 4, the tank 12 defines a water chamber 60 in intimate that transfer relation with and surrounding the exterior surfaces of the combustor unit 16. Importantly, the combustor unit 16 defines a large heat transfer surface area with the flow path 46 extending from one tank end to the curved flow path region disposed near the opposite end and then curving through 180 degrees for passage back to said one end of the tank. In a commercial embodiment of the invention, wherein the tank is sized to fit a standard installation envelope with a diameter of about twelve inches and a length of about sixteen inches, the preferred diametric size of the flow path is about four inches and the remaining water capacity of the chamber 60 is about five to six gallons.

The tank 12 including the combustor unit 16 is mounted for operation with one open end of the flow path disposed below the other open end, as viewed in FIGS. 1 and 2. The lower open end of the flow path 46 provides an open air intake for drawing in combustion air, together with a mounting site for a heating element, such a a gas-fired burner element 62 depicted in FIG. 4. In this regard, gas is supplied to the burner element 62 from a gas supply pipe 64 coupled typically from a bottled gas source 66 in recreational vehicles. The supply pipe 64, however, is interrupted by a control unit 68 mounted on the end wall of the tank head portion 32 and conventionally including a temperature set control 70 together with a standard thermostat device 72 which normally protrudes through an appropriate fitting 74 (FIG. 3) for sensing tank water temperature. Similarly, a pressure relief valve 76 (FIG. 2) and a drain plug 78 are also normally mounted on the end wall on the tank head portion 32 by means of appropriate fittings 80 and 82, respectively.

In operation, the combustion products generated by the burner element 62 flow through the U-shaped combustor unit flow path 46 prior to exhausting through the open upper end of the flow path, and through the vent 24 in the door 20. These hot combustion products transfer heat energy through the walls of the combustor unit 16 to the surrounding water within the chamber 60. This heat transfer can be enhanced, if desired, by inclusion of a baffled or finned heat exchange element 84 (FIGS. 3–5) suitably mounted in the exhaust leg of the combustor unit flow path. In a recreational vehicle water heater of the type and size as described previously herein, heat transfer of about 20,000 BTU's per hour can be achieved, nearly double that of currently available commercial water heaters of the same overall physical size.

Water ingress and egress to the chamber 60 is conveniently obtained by a cold water supply pipe 86 and a hot water outlet pipe 88 (FIG. 1) connected respectively to appropriate threaded fittings 90 and 92 on the end wall of the tank tail portion 34 (FIG. 3). These supply and outlet pipes 86 and 88 thus couple the tank chamber 60 with an appropriate cold water source for rapid heating and outflow of water at about 120°–170° F. for use in cooking, bathing, etc.

The water heater 10 as described above is thus manufactured quickly and easily from a relatively small number of components and with a small number of easily performed welds. The heater has a standard low profile for installation quickly and easily as a unit into the recreational vehicle housing 14 for appropriate association with the gas supply pipe 64. In operation, the heater provides efficient transfer of thermal energy to the water within the tank, whereby that water is heated rapidly and efficiently and with low recovery time.

Various further modifications and improvements to the improved water heater 10 of the present invention are believed to be apparent to those of ordinary skill in the art. Accordingly, no limitation on the invention is intended by way of the description herein, except as set forth in the appended claims.

What is claimed is:

1. A water heater for use in recreational vehicles and the like, comprising:

a tank defining an internal chamber for receiving water to be heated;

a combustor unit mounted within said tank and including means for providing a source of thermal energy, said combustor unit being formed from a pair of generally shell-shaped sections each defining an elongated channel of generally semitubular cross-section with peripheral lips and generally U-shaped configuration with a pair of generally straight legs having open ends and opposite ends merging with a smoothly contoured bend extending through about 180 degrees to form a generally semitubular flow path, said shell-shaped sections being joined together in facing relation at said peripheral lips with said elongated channels cooperatively defining an elongated flow path of generally circular cross sectional shape for flow through passage of combustion products, said combustion products defining said source of thermal energy; and means for supplying water to and discharging water from said tank internal chamber, such that the water within said tank is in heat exchange relation with said combustor unit at the exterior of said elongated flow path.

2. The water heater of claim 1 wherein said tank has a generally cylindrical shape.

3. The water heater of claim 1 wherein said tank is formed from generally cup-shaped head and tail portions joined together to define said internal chamber.

4. The water heater of claim 3 wherein said shell-shaped sections are generally identical to each other.

5. The water heater of claim 3 wherein said shell-shaped sections are defined by a pair of metal stampings.

6. The water heater of claim 1 wherein said shell-shaped sections each further comprise a central web joined between said straight legs of said channel, said pair of sections being joined together by a weld seam extending about the outer peripheries of said legs and bend at said lips.

7. The water heater of claim 6 wherein said channel of each of said sections includes an outer lip of generally U-shaped configurations, said weld seam interconnecting said outer lips of said sections.

8. The water heater of claim 1 wherein said combustor unit is mounted on said tank with the open ends of said legs exposed to the exterior of said tank and with said flow path extending into an exiting from the interior of said tank, one of said open ends having a burner element mounted therein and further defining an air vent for intake of combustion air, the other of said open ends defining an exhaust opening for discharge of combustion products.

9. The water heater of claim 8 further including a heat exchange element mounted within said flow path generally adjacent said exhaust opening.

10. A water heater for use with recreational vehicles and the like, comprising:

a generally cylindrical water tank including generally cup-shaped head and tail portions interfitting together to define an internal chamber for receiving a supply of water;

a combustor unit mounted within said tank internal chamber and defining an elongated flow path having opposite ends exposed to the exterior of the tank and extending into and exiting from said tank, said combustor unit being defined by a pair of generally shell-shaped sections cooperatively forming said flow path to have a generally circular cross sectional shape and peripheral lips, and means connecting said sections together at said peripheral lips, said combustor unit sections cooperatively form said elongated flow path to have a generally U-shaped configuration;

a burner element mounted within one end of said flow path;

means for supplying fuel to said burner element, said fuel supplying means leaving a portion of said one end open to define an air intake vent for combustion air, said other end of said flow path defining an exhaust outlet for products of combustion;

a cold water supply pipe connected to said tank for supplying water into said internal chamber in heat exchange relation with said combustor unit at the exterior of said elongated flow path; and a hot water outlet pipe connected to said tank.

11. The water heater of claim 10 wherein said tank has a diameter of about twelve inches and a length of about sixteen inches.

12. A water heater for use in a recreational vehicle or the like, comprising:

a water tank formed from generally cup-shaped tank head and tail portions joined together to define an internal tank chamber for receiving a supply of water to be heated;

a combustor unit formed from a pair of generally shell-shaped sections each having a generally U-shaped channel of semitubular cross section with said channel having a pair of generally straight legs blending into a curved bend, and a central web interconnecting said legs, said pair of sections being connected together in facing relation to define an elongated flow path of generally U-shaped configuration and generally circular cross sectional shape with an opposite pair of open ends;

said tank head portion having a pair of openings formed therein and interconnected by a narrow slot, said combustor unit being mounted to said head portion with the open ends thereof and a portion of said web of each of said sections projecting through said openings and said slot, the remainder of said combustor unit being within said chamber;

a cold water supply pipe and a hot water outlet pipe connected to said tank tail portion, said cold water supply pipe coupling a flow of water into said tank chamber in heat exchange relation with said combustor unit at the exterior of said elongated flow path; and a thermostat control unit and a pressure relief valve connected to said tank head portion.

13. A method of making a hot water heater for use in a recreational vehicle or the like, said method comprising the steps of:

forming a combustor unit having a generally U-shaped flow path of generally circular cross section from a pair of shell-shaped combustor sections;

mounting the combustor unit into a generally cup-shaped tank head portion with opposite ends of the flow path projecting through and being exposed to the exterior of the head portion;

mounting a generally cup-shaped tank tail portion onto the head portion to form an enclosed tank chamber within said head and tail portions and surrounding said combustor unit within said chamber; and mounting a cold water supply pipe and a hot water outlet pipe onto one of the tank head and tail portions.

* * * * *